US009755344B2

(12) United States Patent
Tong et al.

(10) Patent No.: US 9,755,344 B2
(45) **Date of Patent: *Sep. 5, 2017**

(54) FORCE BIASED SPRING PROBE PIN ASSEMBLY

(71) Applicant: Texas Instruments Incorporated, Dallas, TX (US)

(72) Inventors: Kay Chan Tong, Plano, TX (US); Hisashi Ata, Murphy, TX (US); Thiha Shwe, Murphy, TX (US); Phillip Marcus Blitz, Farmers Branch, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/980,877

(22) Filed: Dec. 28, 2015

(65) Prior Publication Data

US 2017/0187137 A1 Jun. 29, 2017

(51) Int. Cl.
*H01R 13/64* (2006.01)
*H01R 13/24* (2006.01)
(Continued)

(52) U.S. Cl.
CPC ..... *H01R 13/2421* (2013.01); *H01R 4/48* (2013.01); *H01R 4/5058* (2013.01); *H01R 11/18* (2013.01); *H01R 13/2428* (2013.01)

(58) Field of Classification Search
USPC ..... 439/700, 824
See application file for complete search history.

(56) References Cited

U.S. PATENT DOCUMENTS 5,993,269 A 11/1999 Ito
7,315,176 B2 * 1/2008 Nelson ..... G01R 1/06722 324/755.05

(Continued)

FOREIGN PATENT DOCUMENTS

WO WO2013188300 A1 12/2013

OTHER PUBLICATIONS

Notification of Transmittal of the International Search Report and the Written Opinion of the International Searching Authority, or the Declaration, mail date:Dec. 29, 2016 (7 pages).

*Primary Examiner* — Tho D Ta
(74) *Attorney, Agent, or Firm* — Goutham Kondapalli; Charles A. Brill; Frank D. Cimino

(57) ABSTRACT

A force-biased spring probe pin assembly includes a barrel member having a barrel wall defining an elongate internal cavity with a lower end and an upper end. The assembly also includes a first plunger member reciprocally mounted in the internal cavity proximate the lower end of the internal cavity. A spring member is positioned in the internal cavity between the plunger member and the second end of the internal cavity. At least one cavity formed in the plunger member with a conductive bearing in the cavity in electrical contact with the plunger and with the wall of the barrel member. A force-biased spring probe pin assembly includes a barrel member having a barrel wall defining an elongate internal cavity with a lower end and an upper end. The assembly also includes a first plunger member reciprocally mounted in the internal cavity proximate the lower end of the internal cavity and a second plunger member reciprocally mounted in the internal cavity proximate the upper end of the internal cavity. A spring member is positioned in the internal cavity between the first plunger member and the second plunger member. At least one cavity formed in the first plunger member with a first conductive bearing in the (Continued)

cavity in electrical contact with the first plunger and with the wall of the barrel member and at least one cavity formed in the second plunger member with a second conductive bearing in the cavity in electrical contact with the second plunger and with the wall of the barrel member.

14 Claims, 5 Drawing Sheets

(51) Int. Cl.

| | |
|---|---|
| ***H01R 4/50*** | (2006.01) |
| ***H01R 4/48*** | (2006.01) |
| *H01R 11/18* | (2006.01) |

(56) References Cited

U.S. PATENT DOCUMENTS

| | | | | |
|---|---|---|---|---|
| 7,816,929 | B2 | 10/2010 | Yamada | |
| 7,845,955 | B2 | 12/2010 | Nakayama et al. | |
| 8,905,795 | B2 * | 12/2014 | Kim | H01R 13/62 439/482 |
| 9,385,461 | B2 * | 7/2016 | Mori | H01R 13/2421 |
| 9,431,742 | B2 * | 8/2016 | DiFonzo | H01R 13/2421 |
| 2013/0095690 | A1 | 4/2013 | Kim et al. | |

* cited by examiner

FORCE BIASED SPRING PROBE PIN ASSEMBLY

CROSS REFERENCE TO RELATED APPLICATIONS

The following co-pending patent applications are related and hereby incorporated by reference: U.S. patent application Ser. No. 14/980,753, filed simultaneously with this application, U.S. patent application Ser. No. 14/980,953, filed simultaneously with this application, and U.S. patent application Ser. No. 14/981,044, filed simultaneously with this application. With the mention in this section, these patent applications are not admitted to be prior art with respect to the present invention.

This application is related to patent application Ser. No. 14/863,198 entitled "Spring Biased Probe Pin Assembly," with its mention in this section, this patent application is not admitted to be prior art with respect to the present invention.

FIELD

This invention relates a force-biased spring probe pin.

BACKGROUND

A spring probe pin assembly is often also referred to as a Pogo™ pin. Pogo™ is a registered trademark of Xcerra Corporation in Norwood, Mass. A spring probe pin or Pogo™ assembly is a device used in electronics to establish an electrical connection between two circuits. Pogo™ pins are usually arranged in a dense array, connecting together many individual nodes of two circuits or circuit boards. Pogo™ pin connectors are commonly found in automatic test equipment (ATE) in the form of a bed of nails where they facilitate the rapid, reliable connection of the devices under test. A Pogo™ pin connector may contain just a few Pogo™ pins to many hundred Pogo™ pins. In one extremely high-density configuration, the array takes the form of a ring containing hundreds or thousands of individual pogo pins; this device is sometimes referred to as a pogo tower.

Pogo™ pin connectors are also commonly used to form reliable, non permanent electrical contacts in electrical equipment. For example an electronic device with multiple electrical connections may be plugged into an piece of electrical equipment and secured in place for example by a snap connector, a spring, or screws. A Pogo™ pin connector may be used to establish electrical connection. An electronic device installed in electrical equipment in this manner may be easily be removed and replaced without the need of special equipment. This is especially convenient for repairing or updated electrical equipment in the field. For example, Pogo™ pin connectors are used for the installation of devices in the Cray 2 computer.

As shown in FIG. 1, a spring probe pin assembly 100 may have one movable probe pin 102 at one end of the cylindrical barrel member 106 and an immovable pin 116 attached to a closed end of the cylindrical barrel member 106. As shown in FIG. 2 the spring probe pin assembly 200 may have two movable probe pins, 202 and 216, one at each opposing open ends of the cylindrical barrel member 106.

The spring 108 forces the plunger 104 (or plungers 204 and 210 in FIG. 2) into electrical contact with the wall of the barrel member 106. As is illustrated by the arrows 112 in FIG. 1, the current typically flows from the probe pad on the integrated circuit through the probe pin 102, through the plunger 104, through the wall of the barrel member 106, and into the head 110 of the spring probe pin assembly (or the upper plunger 210 and the upper probe pin 216 in FIG. 2).

Although the spring 108 typically forms an electrical path in parallel with the cylindrical barrel member 106 of the spring probe pin assembly, the resistance of the spring is typically so much higher than the resistance of the wall of the barrel member 106 that an insignificant amount of current flows through the spring 108.

A common problem that may arise with a conventional spring probe pin assembly 300 during use is illustrated in FIG. 3. After repeated use, due to wear the contact 314 and 316 between the plunger 304 and the wall of the barrel member 306 may be degraded resulting in increased resistance. The increased resistance may result in an increase in current flowing through the spring 308. Current greater than about 200 mA through the spring 308 of a spring probe pin assembly 300 may cause the spring 308 to heat up and lose temper or may cause the spring 308 to melt.

SUMMARY

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to a more detailed description that is presented later.

A force-biased spring probe pin assembly includes a barrel member having a barrel wall defining an elongate internal cavity with a lower end and an upper end. The assembly also includes a first plunger member reciprocally mounted in the internal cavity proximate the lower end of the internal cavity. A spring member is positioned in the internal cavity between the plunger member and the second end of the internal cavity. At least one cavity formed in the plunger member with a cylindrical bearing in the cavity that applies a slight transverse force to the plunger ensuring good electrical contact between the plunger and the wall of the barrel member. A force-biased spring probe pin assembly includes a barrel member having a barrel wall defining an elongate internal cavity with a lower end and an upper end. The assembly also includes a first plunger member reciprocally mounted in the internal cavity proximate the lower end of the internal cavity and a second plunger member reciprocally mounted in the internal cavity proximate the upper end of the internal cavity. A spring member is positioned in the internal cavity between the first plunger member and the second plunger member. At least one cavity formed in the first plunger member with a first cylindrical bearing in the cavity that applies a slight transverse force to the plunger ensuring good electrical contact between the first plunger and the wall of the barrel member and at least one cavity formed in the second plunger member with a second cylindrical bearing in the cavity that applies a slight transverse force to the second plunger ensuring good electrical contact between the second plunger and the wall of the barrel member.

DETAILED DESCRIPTION OF EXAMPLE EMBODIMENTS

Embodiments of the invention are described with reference to the attached figures. The figures are not drawn to scale and they are provided merely to illustrate the invention. Several aspects of the embodiments are described below with reference to example applications for illustration. It should be understood that numerous specific details, relationships, and methods are set forth to provide an understanding of the invention. One skilled in the relevant art, however, will readily recognize that the invention can be practiced without one or more of the specific details or with other methods. In other instances, well-known structures or operations are not shown in detail to avoid obscuring the invention. The embodiments are not limited by the illustrated ordering of acts or events, as some acts may occur in different orders and/or concurrently with other acts or events. Furthermore, not all illustrated acts or events are required to implement a methodology in accordance with the present invention.

As used herein "force-biased spring probe pin assembly" refers to a spring probe pin assembly that has been modified to apply a slight force that ensures good electrical contact between the plunger and the cylindrical barrel to avoid significant current from flowing through and damaging the spring.

Figure 1:
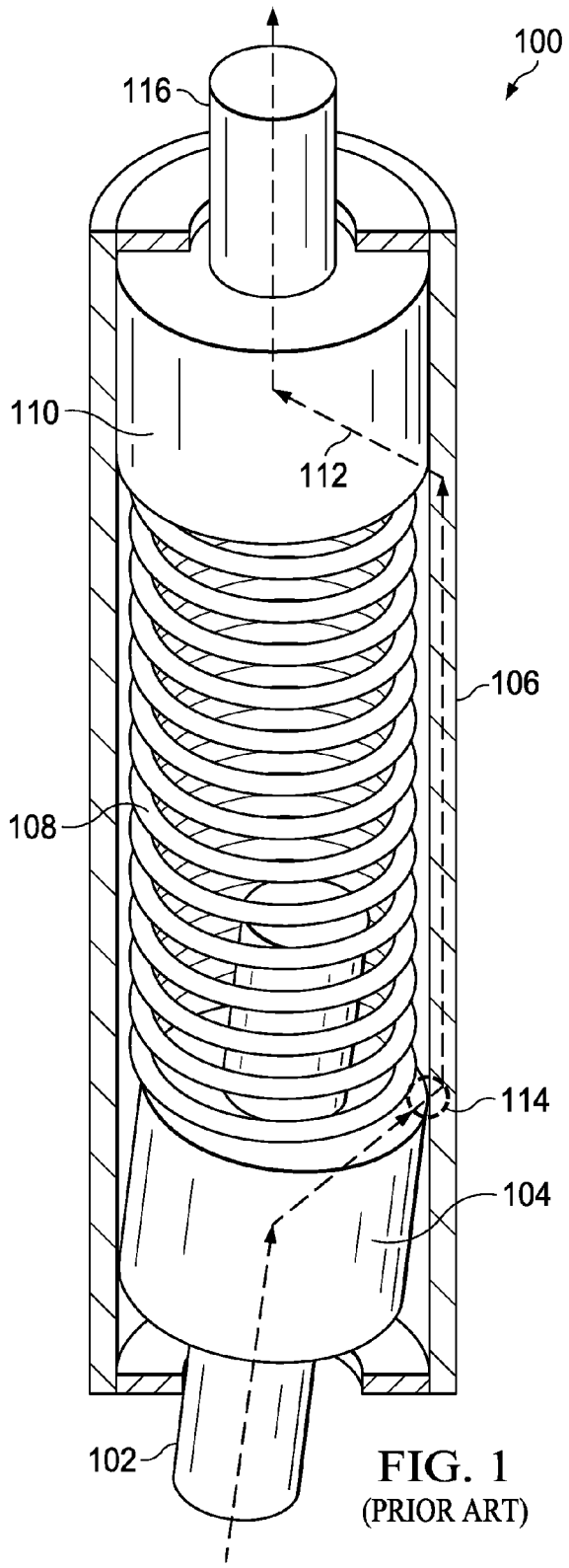
FIG. 1 (PRIOR ART)
FIG. 1 (Prior art) is a partially transparent view of a prior art single ended spring probe pin assembly.
Figure 2:
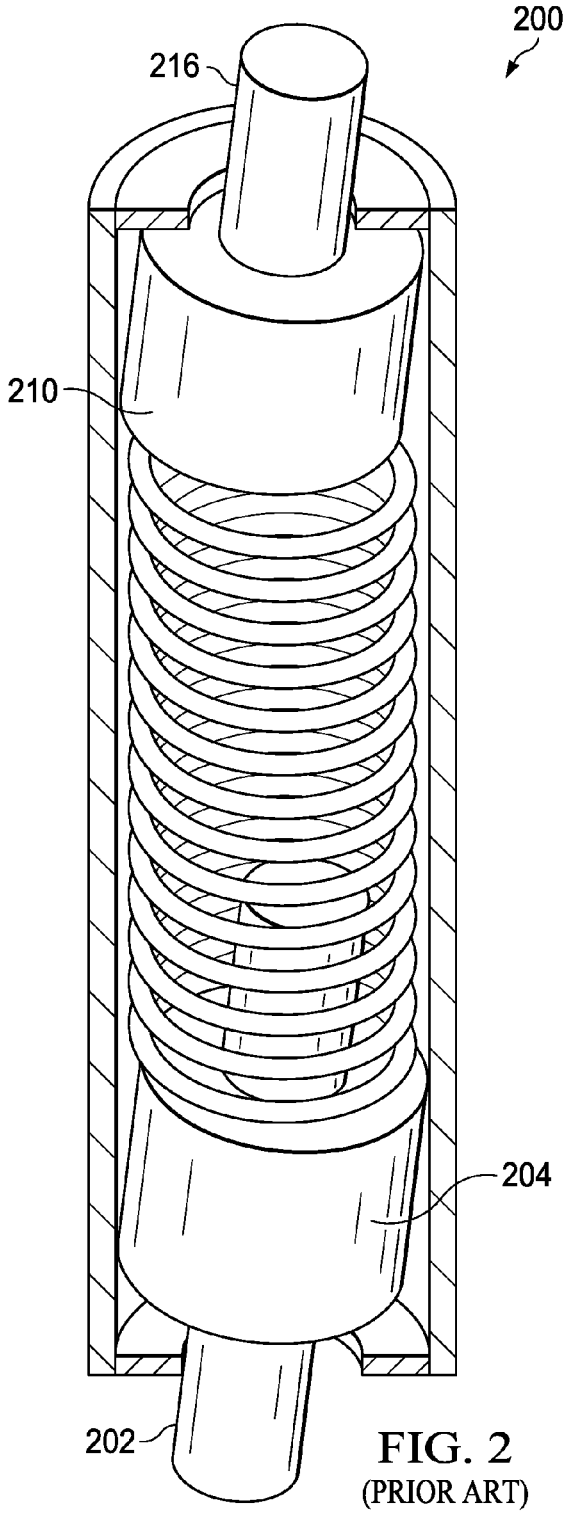
FIG. 2 (PRIOR ART)
FIG. 2 (Prior art) is a partially transparent view of a prior art dual ended spring probe pin assembly.
Figure 3:
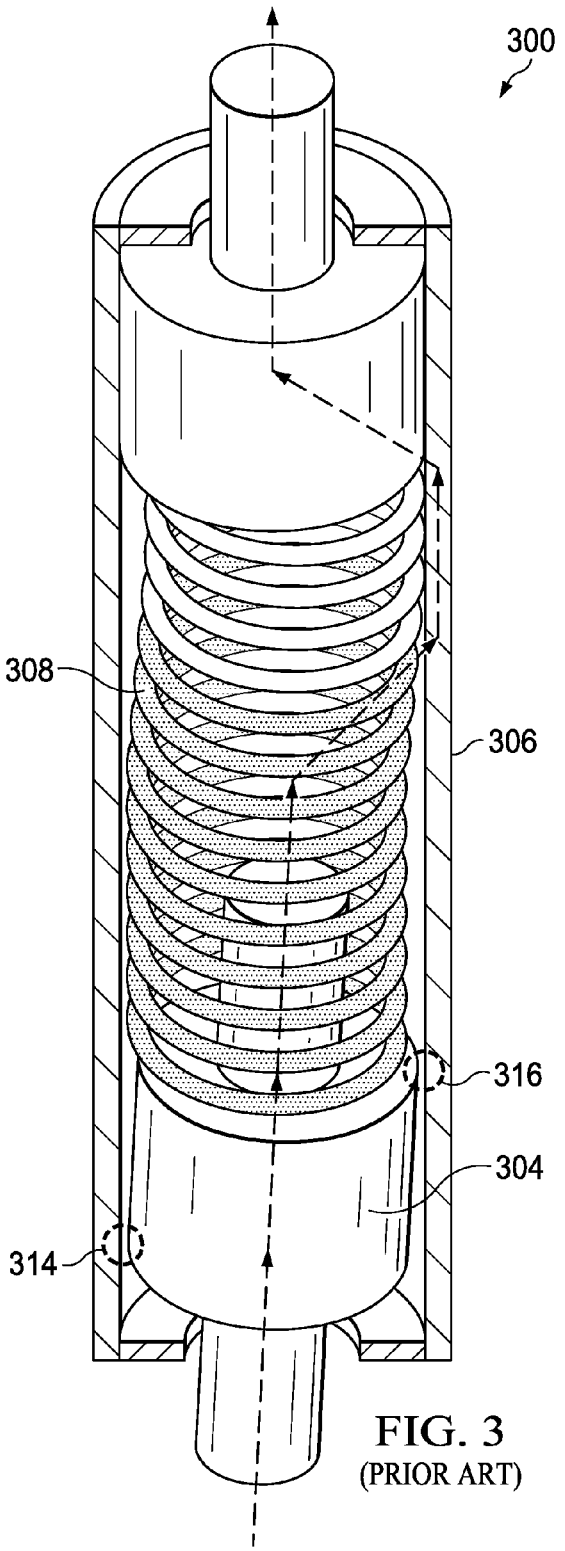
FIG. 3 (PRIOR ART)
FIG. 3 (Prior art) is a partially transparent view of a failed prior art single ended spring probe pin assembly.
Figure 4A:
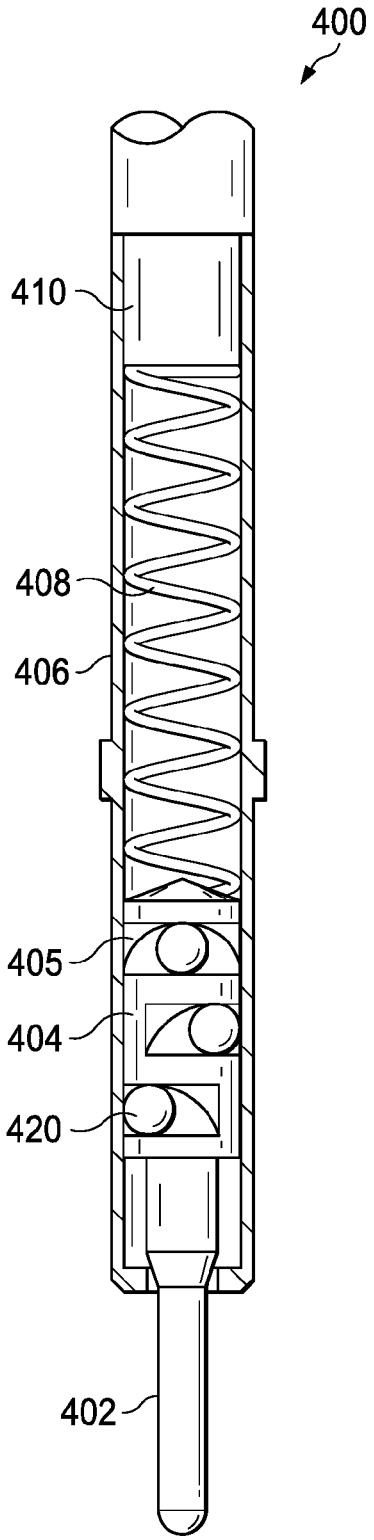
FIG. 4A is a partially transparent view of an example embodiment force-biased single ended spring probe pin assembly with conductive bearings in plunger cavities.
Figure 5:
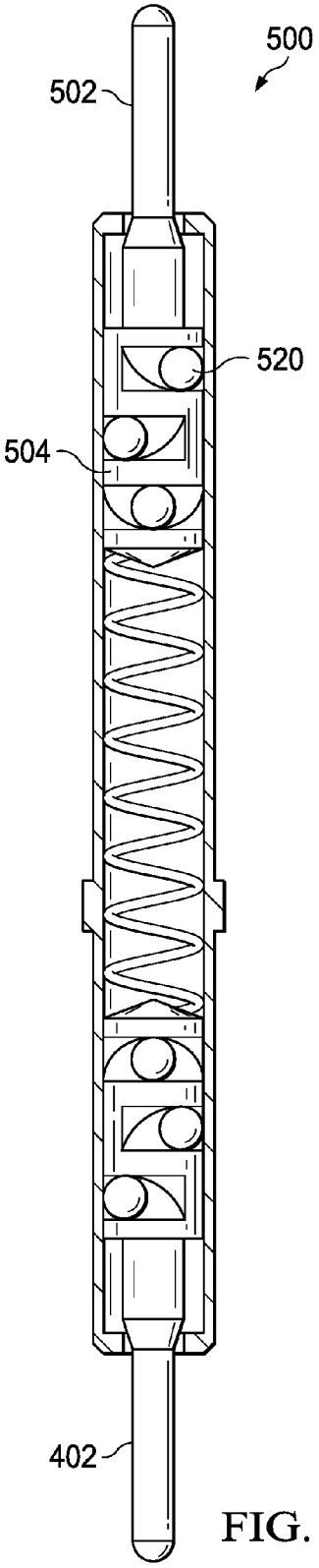
FIG. 5 is a partially transparent view of an example embodiment force-biased dual ended spring probe pin assembly with conductive bearings in plunger cavities.

Embodiments describing force-biased spring probe pin assemblies are illustrated in FIG. 4A and FIG. 5. FIG. 4A is a force-biased single ended spring probe pin assembly 400 with a single plunger 402. FIG. 5 is a force-biased dual ended spring probe pin assembly 500 with two plungers, 402 and 502, on either end of the assembly 500. The probe pin 502 includes plunger 504 and conductive bearing 520 that are identical to plunger 404 and conductive bearing 420 respectively.

As is illustrated in FIG. 4A, cavities are formed within the plunger 404. Conductive bearings 420 within these cavities provide electrical contact between the plunger 404 and the cylindrical barrel 406.

As is illustrated in FIG. 4A, a deformable material 405 such as plastic or rubber may be positioned between the inner wall of the cavity in the plunger 404 and the conductive bearings 420 to apply slight outward force to the conductive bearings 420 to ensure good electrical contact between the conductive bearings 420, the plunger 404, and the cylindrical barrel member 406.

Figure 4B:
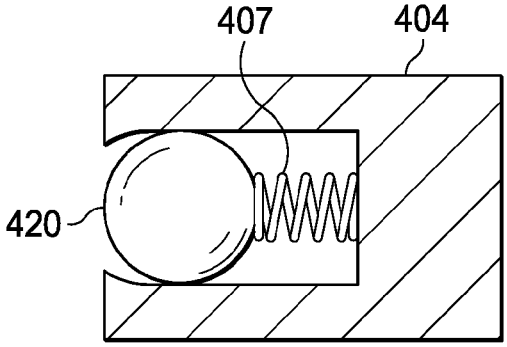
FIG. 4B is a partially transparent view of an example embodiment portion of the plunger with a conductive bearing in a plunger cavity.

Alternatively as shown in FIG. 4B, a metallic spring 407 may be positioned between the inner wall of the cavity in the plunger 404 and the conductive bearing 420 to provide a slight outward force to the conductive bearings 420 to ensure good electrical contact between the conductive bearings 420, the plunger 404, and the cylindrical barrel member 406.

Three conductive bearings 420 are shown in FIG. 4A. More conductive bearings 420 may be used if desired. The bearings 420 in the embodiment force-biased spring probe pin assembly 400 are found to significantly increase the number of times the force-biased spring probe pin assembly may be used prior to failure.

Figure 6:
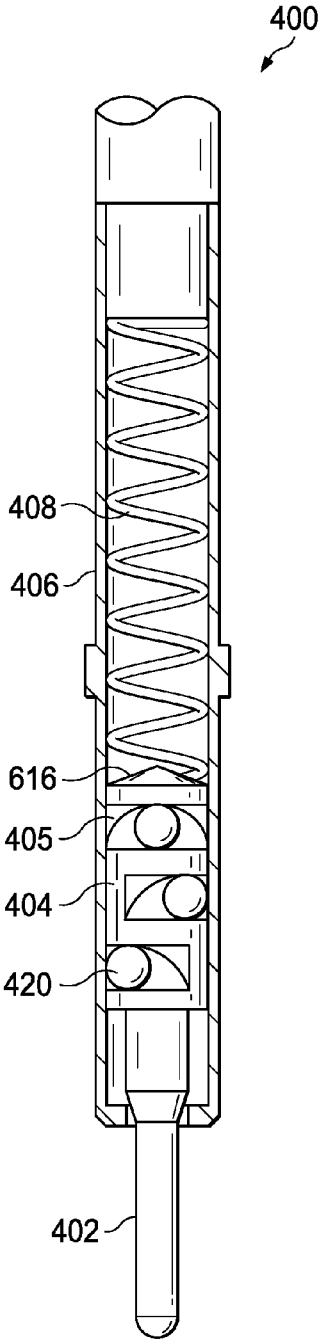
FIG. 6 is a partially transparent view of an example embodiment of a spring-biased probe pin assembly with conductive bearings in plunger cavities and an insert between the plunger and the spring.

As is illustrated in FIG. 6, an insert 616 of a non conductive material may be positioned between the spring 408 and the plunger 404 to prevent current from flowing through and damaging the spring 408.

While various embodiments of the present invention have been described above, it should be understood that they have been presented by way of example only and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

What is claimed is:

1. A force-biased spring probe pin assembly comprising:

a barrel member having a barrel wall defining an elongate internal cavity with a lower end and an upper end;

a plunger member reciprocally mounted in said internal cavity proximate to said lower end of said internal cavity;

a spring member positioned in said internal cavity between said plunger member and said upper end of said internal cavity;

first and second cavities formed within said plunger member; and a first conductive bearing in said first cavity and a second conductive bearing in said second cavity, wherein each of said first conductive bearing and said second conductive bearing is in electrical contact with said plunger member and with said barrel member forming an electrically conductive path between said plunger member and said barrel member.

2. The assembly of claim 1 further comprising:

an insert formed of a non-conductive material, wherein said insert is positioned between said spring member and said plunger member.

3. The assembly of claim 1, wherein said plunger member comprises a third cavity formed within said plunger member, a fourth conductive bearing in said third cavity, wherein said fourth conductive bearing forms an electrically conductive path between said plunger member and said barrel member.

4. The assembly of claim 1 further comprising:

a deformable material within said first cavity of said plunger member wherein said deformable material is positioned between an inside wall of said first cavity and said first conductive bearing, and wherein said deformable material applies a light outward force to said first conductive bearing providing improved electrical contact between said plunger member and said barrel member.

5. The assembly of claim 1 further comprising:

a spring within said first cavity wherein said spring is positioned between an inside wall of said first cavity and said first conductive bearing, and wherein said spring applies a light outward force to said first conductive bearing providing improved electrical contact between said plunger member and said barrel member.

6. The assembly of claim 1 further comprising:

a second plunger member reciprocally mounted in said internal cavity proximate to said upper end, wherein said plunger member mounted proximate to said lower end is a first plunger member;

said spring member positioned in said internal cavity between said first plunger member and said second plunger member;

at least one cavity formed within said second plunger member; and a third conductive bearing in said at least one cavity of said second plunger member, wherein said third conductive bearing forms an electrically conductive path between said second plunger member and said barrel member.

7. The assembly of claim 6, wherein said barrel member having a first opening at said lower end and a second opening at said upper end, said first plunger member comprising a first probe pin extending through said first opening and said second plunger member comprising a second probe pin extending through said second opening.

8. A force-biased spring probe pin assembly comprising:

a barrel member having a barrel wall defining an elongate internal cavity with a lower end and an upper end;

a first plunger member reciprocally mounted in said internal cavity proximate to said lower end of said internal cavity;

a second plunger member reciprocally mounted in said internal cavity proximate said upper end of said internal cavity;

a spring member positioned in said internal cavity between said first plunger member and said second plunger member;

first and second cavities formed within said first plunger member with a first conductive bearing in said first cavity and a second conductive bearing in said second cavity, wherein each of said first conductive bearing and said second conductive bearing is in electrical contact with said first plunger member and in electrical contact with said barrel member forming an electrically conductive path between said first plunger member and said barrel member; and at least one cavity formed within said second plunger member with a third conductive bearing in said at least one cavity of said second plunger member, wherein said third conductive bearing is in electrical contact with said second plunger member and in electrical contact with said barrel member forming an electrically conductive path between said second plunger member and said barrel member.

9. The assembly of claim 8, wherein said first plunger member comprises a third cavity formed in said first plunger member with a fourth conductive bearing in said third cavity, wherein said fourth conductive bearing is in continuous electrical contact with said first plunger member and in continuous electrical contact with said barrel member; and at least one cavity in said second plunger member comprises a second cavity and a third cavity in said second plunger member, a fifth conductive bearing in said second cavity of said second plunger member and a sixth conductive bearing in said third cavity of said second plunger member, wherein said fifth and sixth conductive bearings are in continuous electrical contact with said second plunger member and in continuous electrical contact with said barrel member.

10. The assembly of claim 8, wherein said barrel member having a first opening at said lower end and a second opening at said upper end, said first plunger member comprising a first probe pin extending through said first opening and said second plunger member comprising a second probe pin extending through said second opening.

11. The assembly of claim 8, further comprising:

a deformable material within said first cavity of said first plunger member wherein said deformable material is positioned between an inside wall of said first cavity of said first plunger member and said first conductive bearing, and wherein said deformable material applies a light outward force to said first conductive bearing providing improved electrical contact between said first plunger member and said barrel member; and a deformable material within said first cavity of said second plunger member wherein said deformable material is positioned between an inside wall of said first cavity of said second plunger member and said third conductive bearing, and wherein said deformable material applies a light outward force to said third conductive bearing providing improved electrical contact between said second plunger member and said barrel member.

12. The assembly of claim 8, further comprising:

a first spring within said first cavity of said first plunger member wherein said first spring is positioned between an inside wall of said first cavity of said first plunger member and said first conductive bearing, and wherein said first spring applies a light outward force to said first conductive bearing providing improved electrical contact between said first plunger member and said barrel member; and a second spring within said first cavity of said second plunger member wherein said second spring is positioned between an inside wall of said first cavity of said second plunger member and said third conductive bearing, and wherein said second spring applies a light outward force to said third conductive bearing providing improved electrical contact between said second plunger member and said barrel member.

13. The assembly of claim 8 further comprising:

an insert positioned between said first plunger member and said spring member.

14. The assembly of claim 13, wherein said insert is comprised of a non-conductive material.

* * * * *